US011256197B2

(12) United States Patent
Ashikawa

(10) Patent No.: US 11,256,197 B2
(45) Date of Patent: Feb. 22, 2022

(54) IMAGE FORMING APPARATUS

(71) Applicant: Masahiro Ashikawa, Kanagawa (JP)

(72) Inventor: Masahiro Ashikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/169,894

(22) Filed: Feb. 8, 2021

(65) Prior Publication Data

US 2021/0278785 A1 Sep. 9, 2021

(30) Foreign Application Priority Data

Mar. 6, 2020 (JP) ..... JP2020-038482

(51) Int. Cl.
*G03G 15/16* (2006.01)

(52) U.S. Cl.
CPC ..... *G03G 15/161* (2013.01); *G03G 15/1615* (2013.01); *G03G 15/167* (2013.01)

(58) Field of Classification Search
CPC ..... G03G 15/161; G03G 15/1615; G03G 15/1665; G03G 15/167
See application file for complete search history.

(56) References Cited

U.S. PATENT DOCUMENTS 8,682,189 B2 * 3/2014 Shimizu ..... G03G 15/0136 399/66
8,718,500 B2 * 5/2014 Minbu ..... G03G 15/0131 399/66
9,152,090 B2 * 10/2015 Yoshida ..... G03G 15/14
2010/0034565 A1 2/2010 Ashikawa et al.
2010/0239282 A1 9/2010 Ashikawa et al.
2010/0310292 A1 * 12/2010 Furukawa ..... G03G 15/6561 399/381
2013/0121715 A1 5/2013 Ashikawa et al.
2014/0306633 A1 10/2014 Ashikawa
2014/0314429 A1 * 10/2014 Asano ..... G03G 15/161 399/21
2014/0334847 A1 * 11/2014 Takahashi ..... G03G 15/1605 399/121

(Continued)

FOREIGN PATENT DOCUMENTS

JP 2014-224941 12/2014
JP 2015-060151 3/2015

(Continued)

*Primary Examiner* — Carla J Therrien
(74) *Attorney, Agent, or Firm* — Duft & Bornsen, PC

(57) ABSTRACT

An image forming apparatus includes a transferred body to which a toner image is transferred, a transfer device, a contact-separation device, and circuitry. The transfer device transfers the toner image from the transferred body onto a recording medium. The contact-separation device includes a motor and drives the motor to move the transfer device away from or into contact with the transferred body. The circuitry causes the contact-separation device to move the transfer device away from or into contact with the transferred body. The circuitry moves the transfer device away from the transferred body to a first position during standby and locates the transfer device at a second position that is closer to a contact position at which the transfer device is configured to contact the transferred body than the first position in an interval between the recording medium and a succeeding recording medium.

10 Claims, 7 Drawing Sheets

(56) References Cited

U.S. PATENT DOCUMENTS

| | | | | |
|---|---|---|---|---|
| 2015/0346650 | A1* | 12/2015 | Kato | G03G 15/1665 399/66 |
| 2015/0346651 | A1 | 12/2015 | Nagata et al. | |
| 2016/0139543 | A1* | 5/2016 | Imai | G03G 15/5029 399/121 |
| 2017/0010566 | A1 | 1/2017 | Kato et al. | |
| 2018/0093841 | A1 | 4/2018 | Momose et al. | |
| 2018/0164720 | A1 | 6/2018 | Nagata et al. | |

FOREIGN PATENT DOCUMENTS

| | | |
|---|---|---|
| JP | 2015-225172 | 12/2015 |
| JP | 2016-095376 | 5/2016 |
| JP | 2017-021065 | 1/2017 |
| JP | 2018-097066 | 6/2018 |

* cited by examiner

IMAGE FORMING APPARATUS

CROSS-REFERENCE TO RELATED APPLICATION

This patent application is based on and claims priority pursuant to 35 U.S.C. § 119(a) to Japanese Patent Application No. 2020-038482, filed on Mar. 6, 2020, in the Japan Patent Office, the entire disclosure of which is hereby incorporated by reference herein.

BACKGROUND

Technical Field

Embodiments of the present disclosure relates to an image forming apparatus for forming an image on a recording medium.

Related Art

In a secondary transfer process of an electrophotographic image forming apparatus, shock jitter often occurs when a recording medium enters between an intermediate transfer belt (or a repulsive force roller) and a secondary transfer device (e.g., a secondary transfer roller or a secondary transfer belt). The shock jitter is a phenomenon in which the linear velocity of the secondary transfer device or the intermediate transfer belt suddenly decreases for a moment and disturbs an image. Such shock jitter is one of the causes of image degradation in the image forming apparatus.

SUMMARY

In one embodiment of the present disclosure, a novel image forming apparatus includes a transferred body to which a toner image is transferred, a transfer device, a contact-separation device, and circuitry. The transfer device is configured to transfer the toner image from the transferred body onto a recording medium. The contact-separation device includes a motor. The contact-separation device is configured to drive the motor to move the transfer device away from or into contact with the transferred body. The circuitry is configured to cause the contact-separation device to move the transfer device away from or into contact with the transferred body. The circuitry is configured to move the transfer device away from the transferred body to a first position during standby and locate the transfer device at a second position that is closer to a contact position at which the transfer device is configured to contact the transferred body than the first position in an interval between the recording medium and a succeeding recording medium.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
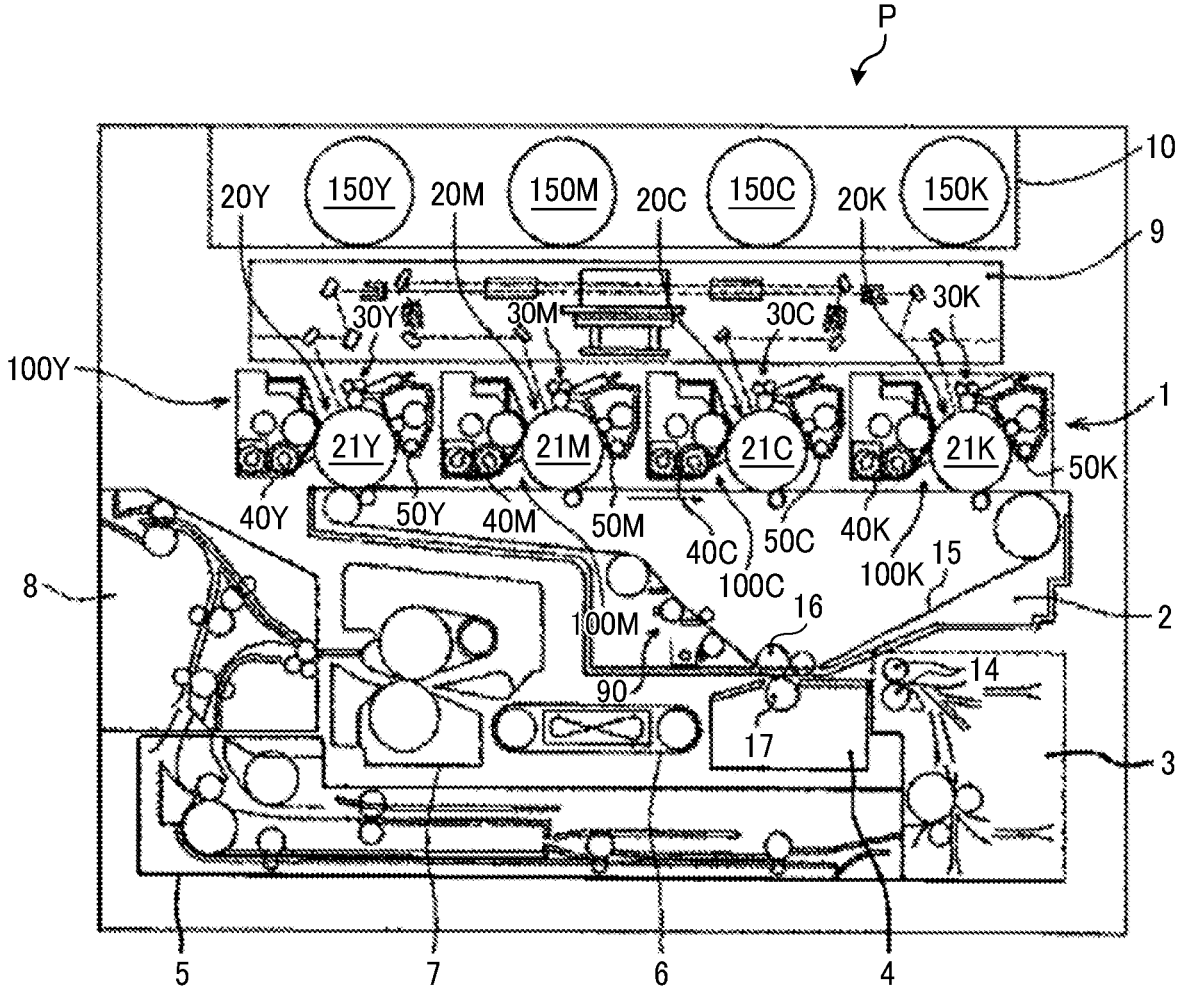
FIG. 1 is a schematic view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result. As used herein, the singular forms "a," "an," and "the" are intended to include the plural forms as well, unless the context clearly indicates otherwise.

In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

It is to be noted that, in the following description, suffixes Y, M, C, and K denote colors of yellow, magenta, cyan, and black, respectively. To simplify the description, these suffixes are omitted unless necessary.

Referring to the drawings, wherein like reference numerals designate identical or corresponding parts throughout the several views, embodiments of the present disclosure are described below.

Initially with reference to FIGS. 1 to 8, a description is given of a first embodiment of the present disclosure.

FIG. 1 is a schematic view of a printer P according to the first embodiment of the present disclosure.

In the present embodiment, the printer P is an electrophotographic printer serving as an image forming apparatus.

Initially with reference to FIG. 1, a description is given of a basic configuration of the printer P according to the present embodiment.

As illustrated in FIG. 1, the printer P includes a tandem device 1 in which photoconductive developing units 100Y, 100M, 100C, and 100K are arranged side by side to form toner images of yellow (Y), magenta (M), cyan (C), and black (K), respectively. Each of the photoconductive developing units 100Y, 100M, 100C and 100K has the following four modules supported by a common unit frame, allowing the four modules, as an integral part, to be attached to and removed from a main body of the printer P.

The first modules are photoconductor modules 20Y, 20M, 20C, and 20K including drum-shaped photoconductors 21Y, 21M, 21C, and 21K, respectively, serving as latent image bearers. The second modules are charging modules 30Y, 30M, 30C, and 30K each including a charging device. The third modules are developing devices 40Y, 40M, 40C, and 40K each employing a two-component developing system to develop the latent image with a developer containing toner and magnetic carriers. The fourth modules are cleaning modules 50Y, 50M, 50C, and 50K each including a drum-shaped cleaning device.

The photoconductor modules 20Y, 20M, 20C, and 20K, the charging modules 30Y, 30M, 30C, and 30K, and the cleaning modules 50Y, 50M, 50C, and 50K are replaceable modules. On the other hand, the developing devices 40Y, 40M, 40C, and 40K are not replaceable modules. Alternatively, however, the developing devices 40Y, 40M, 40C, and 40K may be configured as replaceable modules.

Above the tandem device 1 is an exposure device 9 serving as a latent image forming device. Above the exposure device 9 is a bottle holder 10 that holds toner bottles 150Y, 150M, 150C, and 150K containing Y, M, C, and K toners, which are supplied to the developing devices 40Y, 40M, 40C, and 40K, respectively.

The toner bottles 150Y, 150M, 150C, and 150K are removable from the bottle holder 10. When the toner in any one of the toner bottles 150Y, 150M, 150C, and 150K is consumed, the one of the toner bottles 150Y, 150M, 150C, and 150K is removed from the bottle holder 10 and replaced with a new toner bottle.

Below the tandem device 1 is a transfer unit 2 serving as an intermediate transfer device including an intermediate transfer belt 15 serving as an image bearer and a transferred body. The intermediate transfer belt 15 serving as an intermediate transfer member is an endless belt entrained around a plurality of support rollers. The intermediate transfer belt 15 moves in a clockwise direction in FIG. 1.

Below the transfer unit 2 is a secondary transfer device 4 serving as a transfer device. The secondary transfer device 4 includes a secondary transfer roller 17. The secondary transfer roller 17 contacts an outer circumferential surface of a portion of the intermediate transfer belt 15 around a secondary transfer opposed roller 16 to form a secondary transfer nip between the intermediate transfer belt 15 and the secondary transfer roller 17. A secondary transfer bias is output from a secondary transfer power source and applied to the secondary transfer roller 17. On the other hand, the secondary transfer opposed roller 16 as a repulsive roller is electrically grounded. Thus, a secondary transfer electric field is formed in the secondary transfer nip.

In the printer P according to the embodiment, the transfer unit 2 and the secondary transfer device 4 cooperates to function as a transfer device that transfers a toner image from the outer circumferential surface of the image bearer (i.e., the intermediate transfer belt 15) to a recording sheet S (illustrated in FIG. 4) serving as a recording medium sandwiched between the intermediate transfer belt 15 and the secondary transfer roller 17 in the transfer nip (i.e., secondary transfer nip).

To the left of the secondary transfer device 4 in FIG. 1 is a fixing device 7 that fixes the toner image transferred onto the recording sheet S. The fixing device 7 includes a heating roller having a heat generator inside the heating roller. Between the secondary transfer device 4 and the fixing device 7 is a conveyor belt 6 that conveys the recording sheet S bearing the toner image toward the fixing device 7. In a lower portion of the main body of the printer P, a sheet feeding device 3 is disposed to feed recording sheets S separated and fed one by one from a sheet container to the secondary transfer device 4. To the left of the fixing device 7 in FIG. 1 is a sheet ejection device 8 that conveys the recording sheet S having passed through the fixing device 7 toward the outside of the main body of the printer P or toward a duplex device 5.

Four primary transfer rollers for Y, M, C, and K are disposed inside a loop formed by the intermediate transfer belt 15. The primary transfer rollers for Y, M, C, and K sandwich the intermediate transfer belt 15 together with the photoconductors 21Y, 21M, 21C, and 21K, thus forming primary transfer nips for Y, M, C, and K, respectively, at which the outer circumferential surface of the intermediate transfer belt 15 contacts the respective photoconductors 21Y, 21M, 21C, and 21K. In the primary transfer nips, primary transfer electric fields are formed between the primary transfer rollers to which primary transfer biases are applied and electrostatic latent images developed with toner on the photoconductors 21Y, 21M, 21C, and 21K, to electrostatically move the toner from the photoconductors 21Y, 21M, 21C, and 21K to the outer circumferential surface of the intermediate transfer belt 15.

When the printer P receives image data transmitted from an external device such as a personal computer, the printer P starts a print job while driving, e.g., the intermediate transfer belt 15. In the tandem device 1, as the photoconductors 21Y, 21M, 21C, and 21K rotate, the charging devices of the charging modules 30Y, 30M, 30C, and 30K uniformly charge the surfaces of the photoconductors 21Y, 21M, 21C, and 21K, respectively, to a predetermined charge potential. The exposure device 9 emits laser beams for Y, M, C, and K generated according to the image data, to optically scan the uniformly charged surfaces of the photoconductors 21Y, 21M, 21C, and 21K with the laser beams for Y, M, C, and K, respectively, and form electrostatic latent images for Y, M, C, and K on the surfaces of the photoconductors 21Y, 21M, 21C, and 21K, respectively. The developing devices 40Y, 40M, 40C, and 40K develop the electrostatic latent images into Y, M, C, and K toner images, respectively. Then, in a primary transfer process, the Y, M, C, and K toner images are sequentially transferred onto the intermediate transfer belt 15 such that the Y, M, C, and K toner images are superimposed one atop another on the intermediate transfer belt 15. Thus, a four-color composite toner image is formed on the intermediate transfer belt 15.

After the Y, M, C, and K toner images are transferred onto the intermediate transfer belt 15, some toner may remain on the surfaces of the photoconductors 21Y, 21M, 21C, and 21K as transfer residual toner. The drum cleaning devices of the cleaning modules 50Y, 50M, 50C, and 50K remove the transfer residual toner from the surfaces of the photoconductors 21Y, 21M, 21C, and 21K, respectively.

In parallel with the formation of the toner image described above, the recording sheet S is fed from the sheet container disposed below the duplex device 5, separated from other recording sheets S on the sheet container, and supplied to the sheet feeding device 3. The recording sheet S is conveyed to a registration roller pair 14, which stops the conveyance of the recording sheet S shortly after the recording sheet S collides with the registration roller pair 14. Rotation of the registration roller pair 14 is timed to convey the recording sheet S toward the secondary transfer nip so that the recording sheet S meets the four-color toner image on the intermediate transfer belt 15 reaching the secondary transfer nip. The recording sheet S thus conveyed again by the rotation of the registration roller pair 14 meets the four-color toner image on the intermediate transfer belt 15 in the secondary transfer nip. Thus, the secondary transfer device 4 secondarily transfers the four-color toner image from the intermediate transfer belt 15 onto the recording sheet S. In other words, a full-color image is formed on the recording sheet S. The recording sheet S bearing the toner image is conveyed into the fixing device 7 by the conveyor belt 6. The fixing device 7 applies heat and pressure to the recording sheet S to fix the full-color toner image onto the surface of the recording sheet S. The recording sheet S bearing the fixed toner image is then conveyed to the sheet ejection device 8.

The sheet ejection device 8 switches the passage for the recording sheet S by moving a switching claw between a passage toward an output tray disposed outside the main body of the printer P (to the left of the main body of the printer P in FIG. 1) and a passage toward the duplex device 5 in the lower portion of the main body of the printer P. The duplex device 5 resends the recording sheet S to the secondary transfer nip while reversing the recording sheet S upside down. The re-fed recording sheet S is fed to the secondary transfer nip in which the secondary transfer device 4 secondarily transfers a toner image from the intermediate transfer belt 15 onto the back side of the recording sheet S. After passing through the fixing device 7, the recording sheet S is ejected onto the output tray by the sheet ejection device 8. Note that, after the intermediate transfer belt 15 passes through the secondary transfer nip, some toner may remain on the outer circumferential surface of the intermediate transfer belt 15 as transfer residual toner. An intermediate transfer belt cleaning device 90 removes the transfer residual toner from the outer circumferential surface of the intermediate transfer belt 15.

Figure 2:
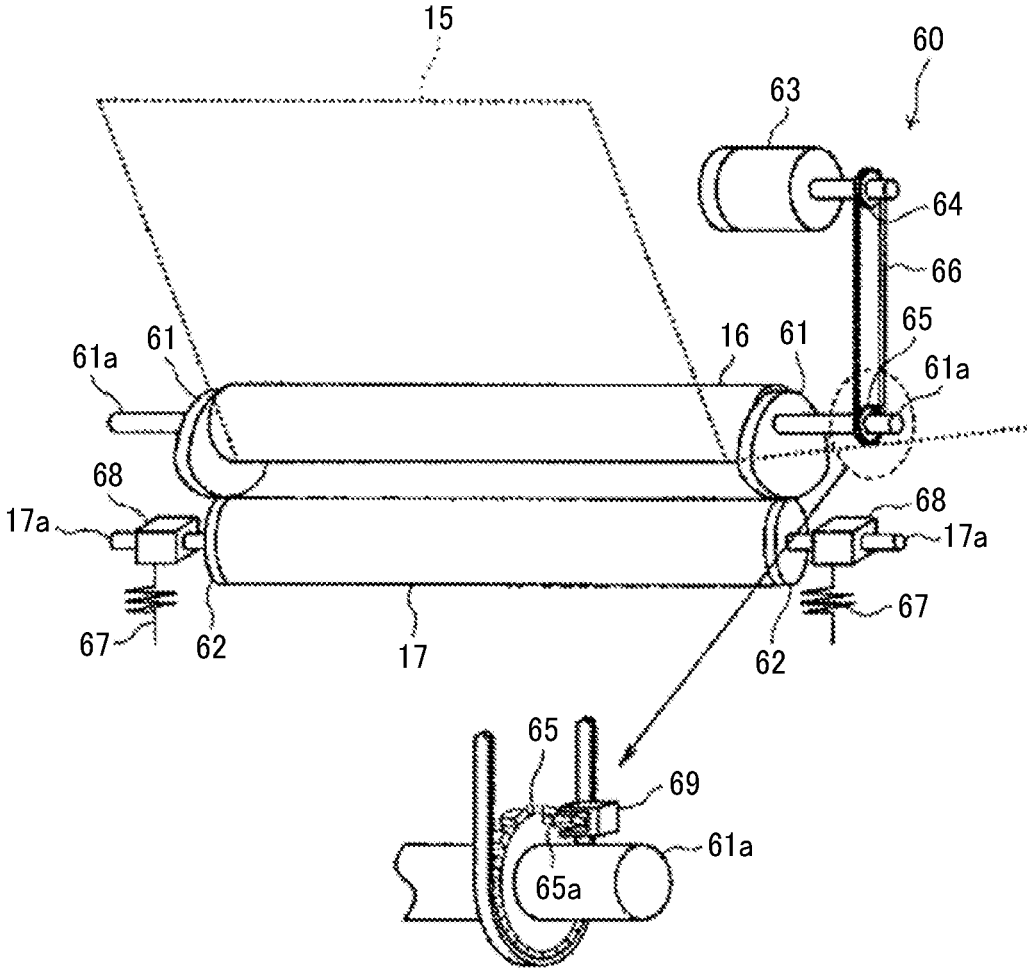
FIG. 2 is a perspective view of a secondary-transfer contact-separation device that causes an intermediate transfer belt and a secondary transfer roller to contact each other and separates the intermediate transfer belt and the secondary transfer roller from each other.

Referring now to FIG. 2, a description is given of a secondary-transfer contact-separation device 60 serving as a contact-separation device that causes the intermediate transfer belt 15 and the secondary transfer roller 17 to contact each other and separates the intermediate transfer belt 15 and the secondary transfer roller 17 from each other.

FIG. 2 is a perspective view of the secondary-transfer contact-separation device 60.

In FIG. 2, the secondary transfer opposed roller 16 is disposed opposite and above the secondary transfer roller 17 with the intermediate transfer belt 15 interposed between the secondary transfer opposed roller 16 and the secondary transfer roller 17. A spring 67 serving as a biasing member urges the secondary transfer roller 17 toward the secondary transfer opposed roller 16.

The secondary-transfer contact-separation device 60 includes a stepping motor 63 and two eccentric cams 61. The secondary-transfer contact-separation device 60 freely causes the intermediate transfer belt 15 and the secondary transfer roller 17 to contact each other and separates the intermediate transfer belt 15 and the secondary transfer roller 17 from each other within a given range. Each of the eccentric cams 61 is disposed coaxially with the secondary transfer opposed roller 16 on each axial end side of the secondary transfer opposed roller 16.

The two eccentric cams 61 are linked to each other by a cam shaft 61*a* to which the eccentric cams 61 are fixed. The cam shaft 61*a* passes through a through hole provided at the rotation center of the secondary transfer opposed roller 16. One of the two eccentric cams 61 rotates about the cam shaft 61*a* outside one axial end of the secondary transfer opposed roller 16. The other one of the two eccentric cams 61 rotates about the cam shaft 61*a* outside the other axial end of the secondary transfer opposed roller 16

The secondary transfer opposed roller 16 is supported by the cam shaft 61*a*, as being able to idle on the circumferential surface of the cam shaft 61*a*. Rotation of the endless intermediate transfer belt 15 wound around a part of the circumferential surface of the secondary transfer opposed roller 16 rotates the secondary transfer opposed roller 16.

A shaft 17*a* projects from each axial end surface of a roller portion of the secondary transfer roller 17 at a rotational center position of the secondary transfer roller 17. The shaft 17*a* rotates together with the roller portion of the secondary transfer roller 17 while being rotatably borne by bearings 68.

A ball bearing 62 through which the shaft 17*a* passes is disposed outside each axial side of the roller portion of the secondary transfer roller 17, so as not to rotate together with the shaft 17*a*. Depending on the pausing posture of the cam shaft 61*a*, a relatively large diameter portion of the eccentric cam 61 abuts against the ball bearing 62, thus forming a gap between the intermediate transfer belt 15 and the secondary transfer roller 17. Note that the pausing posture of the cam shaft 61*a* is a posture of the cam shaft 61*a* when the cam shaft 61*a* stops rotating.

A cam gear 65 is fixed to the cam shaft 61*a*. A motor gear 64 is fixed to a motor shaft of the stepping motor 63. A timing belt 66 is entrained around the cam gear 65 and the motor gear 64. Rotation of the stepping motor 63 is controllable at a step angle of 1.8°. As the stepping motor 63 rotates, a rotational driving force is transmitted from the stepping motor 63 to the cam gear 65 via the timing belt 66, thus rotating the two eccentric cams 61 fixed to the cam shaft 61*a* in the same phase. The eccentric cams 61 are fitted to the cam shaft 61*a* via, e.g., a D-cut groove, to rotate in the same phase.

A shortest portion of the eccentric cam 61 having a shortest distance between the rotation center of the eccentric cam 61 and an external portion of the eccentric cam 61 is shorter than the diameter of the secondary transfer opposed roller 16. When the eccentric cam 61 stops rotating in a posture of directing the shortest portion of the eccentric cam 61 toward the ball bearing 62, the eccentric cam 61 does not abut against the ball bearing 62. Therefore, the eccentric cam 61 does not urge the secondary transfer roller 17 in a direction away from the intermediate transfer belt 15. On the other hand, a biasing force of the spring 67 presses the secondary transfer roller 17 against the intermediate transfer belt 15, thus forming the secondary transfer nip between the secondary transfer roller 17 and the intermediate transfer belt 15.

A longest portion of the eccentric cam 61 having a longest distance between the rotation center of the eccentric cam 61 and the external portion of the eccentric cam 61 is longer than the diameter of the secondary transfer opposed roller 16. When the eccentric cam 61 stops rotating in a posture of directing the longest portion of the eccentric cam 61 toward the ball bearing 62 as illustrated in FIG. 2, the eccentric cam 61 abuts against the ball bearing 62 and urges the ball bearing 62 in a direction away from the intermediate transfer belt 15. Accordingly, the secondary transfer roller 17 is separated from the intermediate transfer belt 15. In other words, the secondary transfer roller 17 is moved away from the intermediate transfer belt 15. That is, the secondary transfer nip is not formed between the secondary transfer roller 17 and the intermediate transfer belt 15.

A reference position projection 65*a* is disposed at a given position in a circumferential direction of the cam gear 65 and projects from a side face of the cam gear 65. A rotational posture detection sensor 69 as a transmissive optical sensor is lateral to the cam gear 65. When the cam gear 65 is in a reference rotational posture as a given rotational posture, the reference position projection 65*a* of the cam gear 65 enters between a light emitting element of the rotational posture detection sensor 69 and a light receiving element of the rotational posture detection sensor 69. Since the cam gear 65 rotates together with the eccentric cam 61, the rotational posture detection sensor 69 detects the reference position projection 65*a*, thus detecting that the eccentric cam 61 has reached a given reference rotational posture. When detecting the reference position projection 65*a*, the rotational posture detection sensor 69 outputs a reference detection signal to a controller 200 described below.

Figure 3:
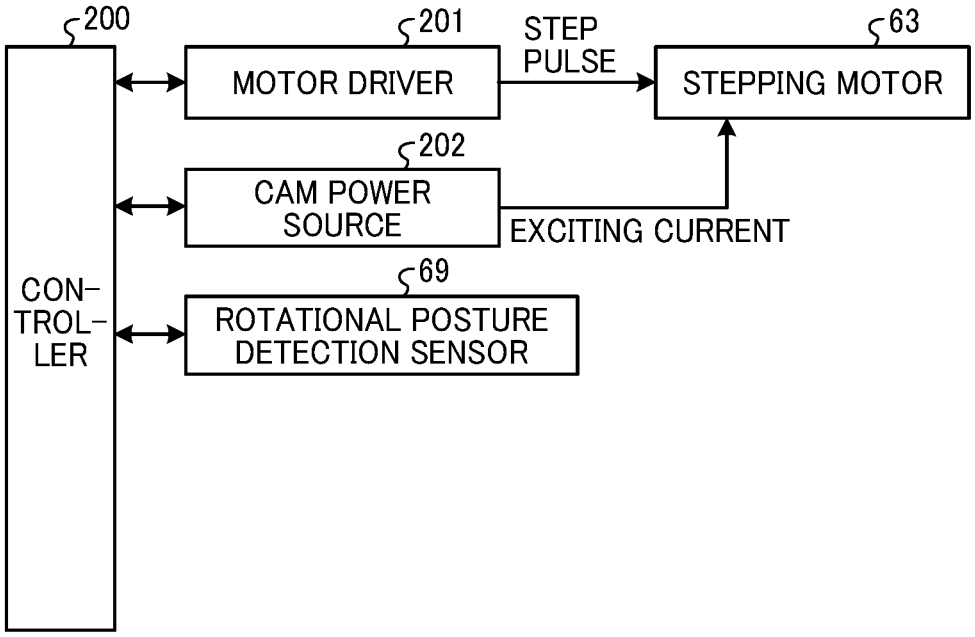
FIG. 3 is a block diagram illustrating a part of an electric circuit of the printer of FIG. 1.

FIG. 3 is a block diagram illustrating a part of an electric circuit of the printer P.

In FIG. 3, the controller 200 controls driving of inner components of the printer P and performs various types of arithmetic processing. Although various electric devices are connected to the controller 200, FIG. 3 illustrates main electric devices of the various electric devices.

The controller 200 includes a control unit such as a central processing unit (CPU) and storage devices such as a read only memory (ROM) and a random access memory (RAM). The controller 200 has a hardware configuration with a general computer.

A program executed by the controller 200 of the printer P of the present embodiment is stored in a computer-readable storage medium in an installable or executable file format and provided. Examples of the computer-readable storage medium include, but are not limited to, a compact disc read-only memory (CD-ROM), a flexible disk (FD), a compact disc recordable (CD-R), and a digital versatile disk (DVD).

Alternatively, the program executed by the controller 200 of the printer P of the present embodiment may be stored on a computer connected to a network such as the Internet and downloaded via the network, to be provided. The program executed by the controller 200 of the printer P of the present embodiment may be provided or distributed via a network such as the Internet.

A motor driver 201 controls driving of the stepping motor 63. The motor driver 201 controls the number of step pulses transmitted to the stepping motor 63 to finely adjust the rotational angle of the stepping motor 63. When the motor driver 201 does not transmit the step pulse to the stepping motor 63, the stepping motor 63 is stopped. At this time, the stepping motor 63 is supplied with an exciting current to magnetically constrain the motor shaft, thus refraining from idling.

When the controller 200 issues, to the motor driver 201, a control signal for rotating the stepping motor 63 by a given rotational angle, the motor driver 201 transmits the number of step pulses corresponding to the control signal to the stepping motor 63. In response to the step pulses transmitted from the motor driver 201, the stepping motor 63 rotates by the given rotational angle, thus rotating the eccentric cams 61 by the given rotational angle. By such control, the controller 200 freely adjusts the pausing posture of the eccentric cam 61. Note that the pausing posture of the eccentric cam 61 is a posture of the eccentric cam 61 when the eccentric cam 61 stop rotating.

A cam power source 202 outputs and supplies a current to the stepping motor 63. When the main power of the printer P is turned off and therefore no current is output from the cam power source 202, the motor shaft of the stepping motor 63 may slightly idle due to vibration, for example. The reference position projection 65*a* and the rotational posture detection sensor 69 are provided to accurately ascertain the rotational posture of the eccentric cams 61 even when the motor shaft of the stepping motor 63 idles.

Immediately after the main power of the printer P is turned on, the controller 200 performs a process to ascertain the rotational posture of the eccentric cams 61. In the process, the controller 200 transmits a motor driving signal to the motor driver 201 to drive and rotate the stepping motor 63 while waiting for a reference attitude time at which a reference detection signal is transmitted from the rotational posture detection sensor 69. When the reference attitude time arrives, the controller 200 transmits, to the motor driver 201, a signal for causing the stepping motor 63 to make one rotation after the arrival of the reference attitude time. As a consequence, the eccentric cams 61 stop rotating in a reference pausing posture. Thereafter, the controller 200 ascertains the rotational posture of the eccentric cams 61 based on the accumulation of the angles by which the eccentric cams 61 are rotated according to the control signals transmitted to the motor driver 201 from the controller 200.

In the above description, for the sake of convenience, the recording sheet S is fed from the registration roller pair 14 toward the secondary transfer nip. However, strictly speaking, the controller 200 separates the intermediate transfer belt 15 and the secondary transfer roller 17 from each other immediately before the recording sheet S enters between the intermediate transfer belt 15 and the secondary transfer roller 17. Hereinafter, a close area between the intermediate transfer belt 15 and the secondary transfer roller 17 in a state in which the intermediate transfer belt 15 and the secondary transfer roller 17 are separated from each other is referred to as a separation secondary-transfer area.

When the recording sheet S is fed into the secondary transfer nip while the secondary transfer roller 17 is kept in contact with the intermediate transfer belt 15, a phenomenon called shock jitter easily occurs. The shock jitter is a phenomenon as follows. That is, when the leading end of the recording sheet S is nipped at the secondary transfer nip, the torque of the stepping motor 63 for driving the secondary transfer roller 17 and the torque of the motor for driving the intermediate transfer belt 15 are rapidly increased. As a consequence, the linear velocity of the secondary transfer roller 17 and the linear velocity of the intermediate transfer belt 15 suddenly decrease for a moment, thus disturbing an image. Such a phenomenon is called shock jitter.

In order to reduce the occurrence of such shock jitter, the printer P according to the embodiment executes the following operation.

Figure 4:
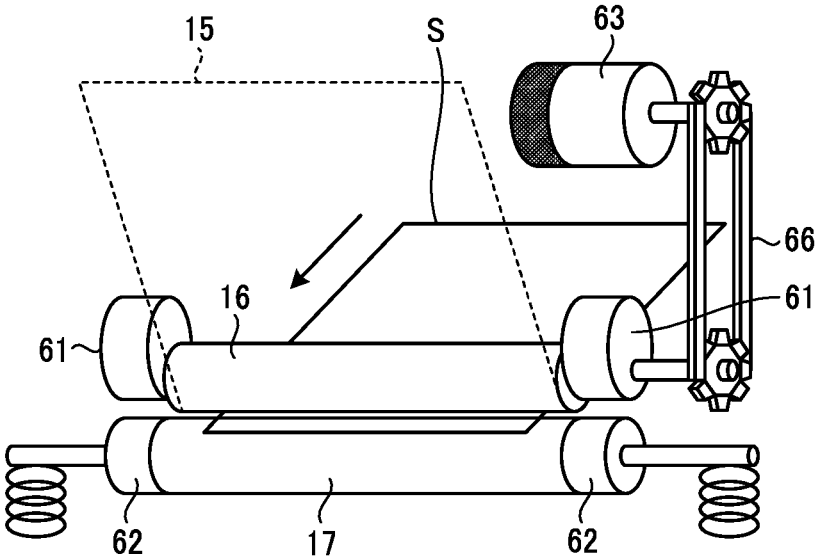
FIG. 4 is a diagram illustrating an operation of the secondary-transfer contact-separation device of FIG. 2 when a recording sheet enters between the intermediate transfer belt and the secondary transfer roller.

FIG. 4 is a diagram illustrating an operation of the secondary-transfer contact-separation device 60 when the recording sheet S enters between the intermediate transfer belt 15 and the secondary transfer roller 17.

As illustrated in FIG. 4, the controller 200 derives the stepping motor 63 to rotate the timing belt 66 and the cam shaft 61*a*, thus rotating the eccentric cams 61 to separate the eccentric cams 61 from the rotation shaft 17*a* of the secondary transfer roller 17. Accordingly, the controller 200 brings the secondary transfer roller 17 and the intermediate transfer belt 15 (together with the secondary transfer opposed roller 16) into contact with each other. Then, immediately before the recording sheet S enters the secondary transfer nip, the controller 200 separates (or moves) the secondary transfer roller 17 away from the intermediate transfer belt 15 (and the secondary transfer opposed roller 16) and causes the recording sheet S to enter the separation secondary-transfer area. The increase in torque of the motor when the recording sheet S enters the separation secondary transfer area is reduced to a greater extent than the increase in torque of the motor when the recording sheet S enters into the secondary transfer nip. That is, the impact caused by the entry of the recording sheet S is reduced. Thus, the present embodiment reduces the occurrence of shock jitter.

Immediately after sending the leading end of the recording sheet S to the separation secondary-transfer area, the controller 200 reversely drives the stepping motor 63 to reversely rotate the eccentric cams 61, resulting in the secondary transfer roller 17 being pressed against the recording sheet S and the intermediate transfer belt 15. Accordingly, a desired pressure is applied at the secondary transfer nip.

Figure 5:
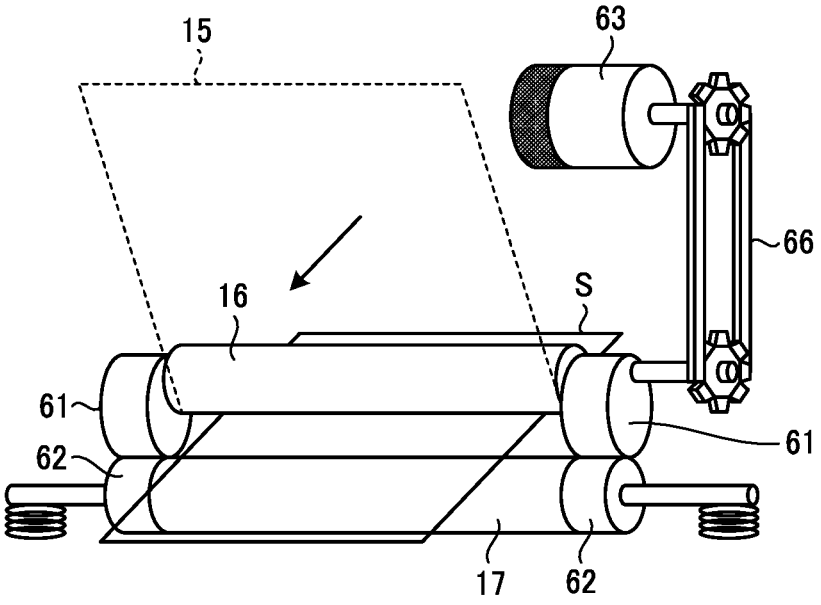
FIG. 5 is a diagram illustrating an operation of the secondary-transfer contact-separation device of FIG. 2 when the recording sheet of FIG. 4 is discharged from between the intermediate transfer belt and the secondary transfer roller.

FIG. 5 is a diagram illustrating an operation of the secondary-transfer contact-separation device 60 when the recording sheet S is discharged from between the intermediate transfer belt 15 and the secondary transfer roller 17.

In order to discharge the recording sheet S from the secondary transfer nip, similarly to the time of entry of the recording sheet S, the controller 200 drives the stepping motor 63 to rotate the timing belt 66 and the cam shaft 61*a*, thus rotating the eccentric cams 61 in a normal direction to cause the eccentric cams 61 to press down the shaft 17*a* of the secondary transfer roller 17, as illustrated in FIG. 5. That is, the controller 200 separates the secondary transfer roller 17 from the intermediate transfer belt 15 (and the secondary transfer opposed roller 16) before the trailing end of the recording sheet S is discharged from the secondary transfer nip. Accordingly, the impact is reduced when the recording sheet S comes out of the secondary transfer nip. Thus, the present embodiment prevents image deterioration that may be caused by the impact generated when the recording sheet S comes out of the secondary transfer nip.

Now, a description is given of contact and separation operations of the secondary-transfer contact-separation device 60 at a time other than an interval between the recording sheets S.

Figure 6:
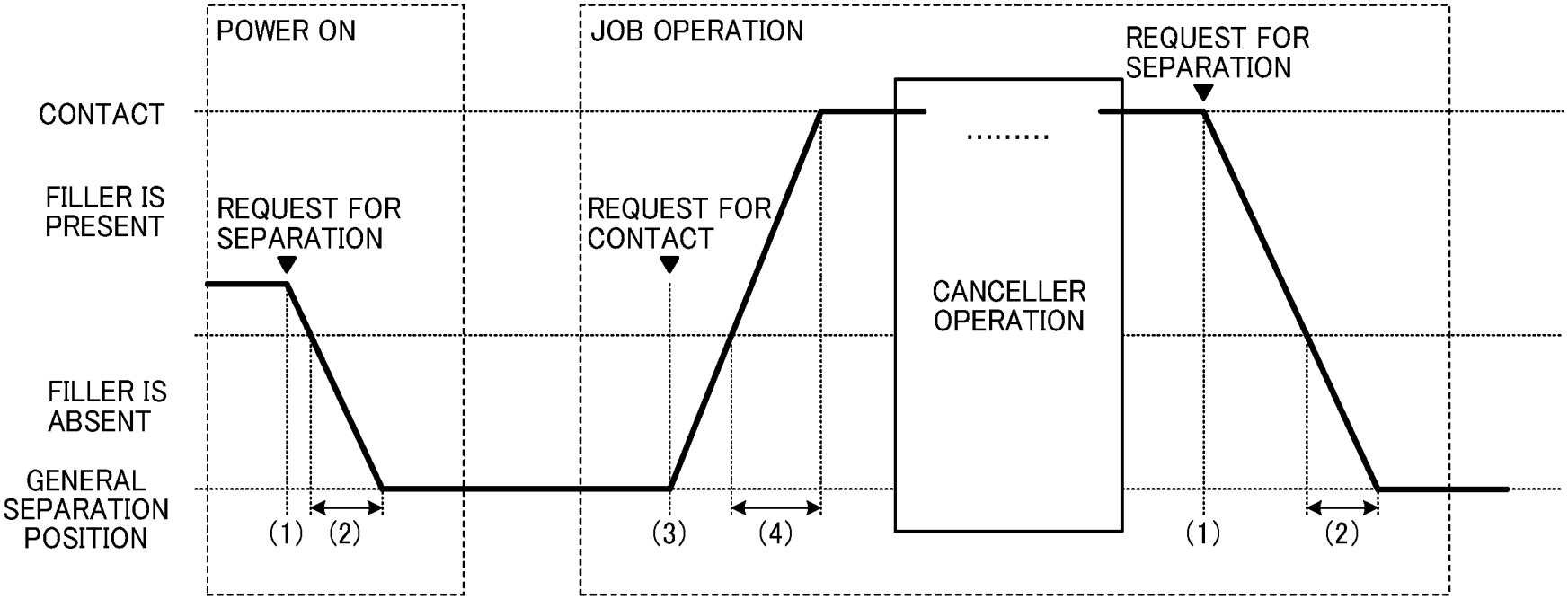
FIG. 6 is a diagram illustrating contact and separation operations of the secondary-transfer contact-separation device of FIG. 2 at a time other than an interval between recording sheets.

FIG. 6 is a diagram illustrating contact and separation operations of the secondary-transfer contact-separation device 60 at a time other than an interval between the recording sheets S.

A description is now given of a general separation operation and a general contact operation individually.

Initially, a description is given of the general separation operation.

In (1) in FIG. 6, in response to a request for separation as the power is turned on, the controller 200 of the printer P causes the stepping motor 63 to rotate in a counterclockwise (CCW) direction.

Next in (2) in FIG. 6, when detecting the change from the presence of a filler to the absence of the filler, that is, when detecting the separation of the secondary transfer roller 17 from the intermediate transfer belt 15 (and the secondary transfer opposed roller 16), the controller 200 of the printer P causes the stepping motor 63 to rotate by a given pulse to stop the secondary transfer roller 17 at a general separation position (as a first position).

Now, a description is given of the general contact operation.

In (3) in FIG. 6, in response to a request for contact in association with a job operation, the controller 200 of the printer P causes the stepping motor 63 to rotate in a clockwise (CW) direction.

Next, in (4) in FIG. 6, when detecting the change from the absence of the filler to the presence of the filler, that is, when detecting the separation of the secondary transfer roller 17 from the intermediate transfer belt 15 (and the secondary transfer opposed roller 16), the controller 200 of the printer P causes the stepping motor 63 to rotate by a given pulse to bring (or move) the secondary transfer roller 17 into contact with the intermediate transfer belt 15 (and the secondary transfer opposed roller 16) and stops the secondary transfer roller 17.

Thereafter, the controller 200 of the printer P executes canceller operations in accordance with the job operation. Here, the canceller operations are an entry-time shock canceller operation and a discharge-time shock canceller operation. The entry-time shock canceller operation is an operation of separating the secondary transfer roller 17 from the intermediate transfer belt 15 by a separation distance corresponding to the thickness of the recording sheet S in the separation secondary-transfer area at a time immediately before the entry of the recording sheets S, in order to reduce the occurrence of shock jitter. The discharge-time shock canceller operation is an operation of slightly driving the stepping motor 63 to stop the eccentric cams 61 in the same posture as the posture of the eccentric cams 61 in the entry-time shock canceller operation, at a time immediately before the trailing end of the recording sheet S is discharged from the secondary transfer nip after a post-entry nip forming operation is performed.

In (1) after the canceller operations in FIG. 6, in response to the request for separation, the controller 200 of the printer P causes the stepping motor 63 to rotate in the CCW direction.

Then, in (2) in FIG. 6, when detecting the change from the presence of the filler to the absence of the filler, that is, when detecting the separation of the secondary transfer roller 17 from the intermediate transfer belt 15 (and the secondary transfer opposed roller 16), the controller 200 of the printer P causes the stepping motor 63 to rotate by a given pulse to stop the secondary transfer roller 17 at the general separation position.

A description is now given of the contact and separation operations of the secondary-transfer contact-separation device 60 in an interval between the recording sheets S.

Figure 7:
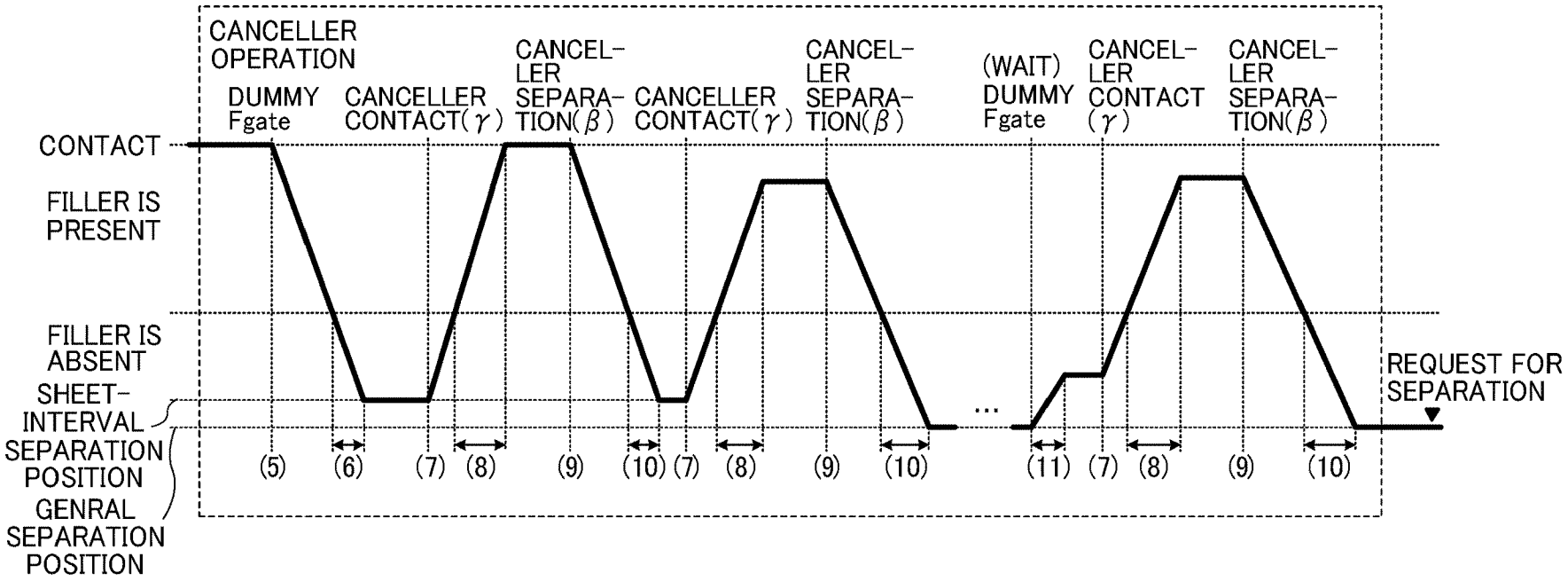
FIG. 7 is a diagram illustrating the contact and separation operations of the secondary-transfer contact-separation device of FIG. 2 in an interval between recording sheets.

FIG. 7 is a diagram illustrating the contact and separation operations of the secondary-transfer contact-separation device 60 in an interval between the recording sheets S.

A description is now given of a first-sheet limited operation (in a contact state), a canceller contact operation, a canceller separation operation, and a first-sheet limited operation (in a separation state) individually.

Initially, a description is given of the first-sheet limited operation (in the contact state).

In (5) in FIG. 7, the controller 200 of the printer P causes the stepping motor 63 to rotate in the CCW direction at a dummy Fgate time. Note that the dummy Fgate time is a time (after 250 milli seconds from Fgate) generated in a time-to-digital converter (TDC) circuit with reference to Fgate.

Next in (6) in FIG. 7, when detecting the change from the presence of the filler to the absence of the filler, that is, when detecting the separation of the secondary transfer roller 17 from the intermediate transfer belt 15 (and the secondary transfer opposed roller 16), the controller 200 of the printer P causes the stepping motor 63 to rotate by a given pulse for each of the recording sheets S to stop the secondary transfer roller 17 at a sheet-interval separation position (as a second position).

Now, a description is given of the sheet-interval separation position (i.e., the second position).

Figure 8:
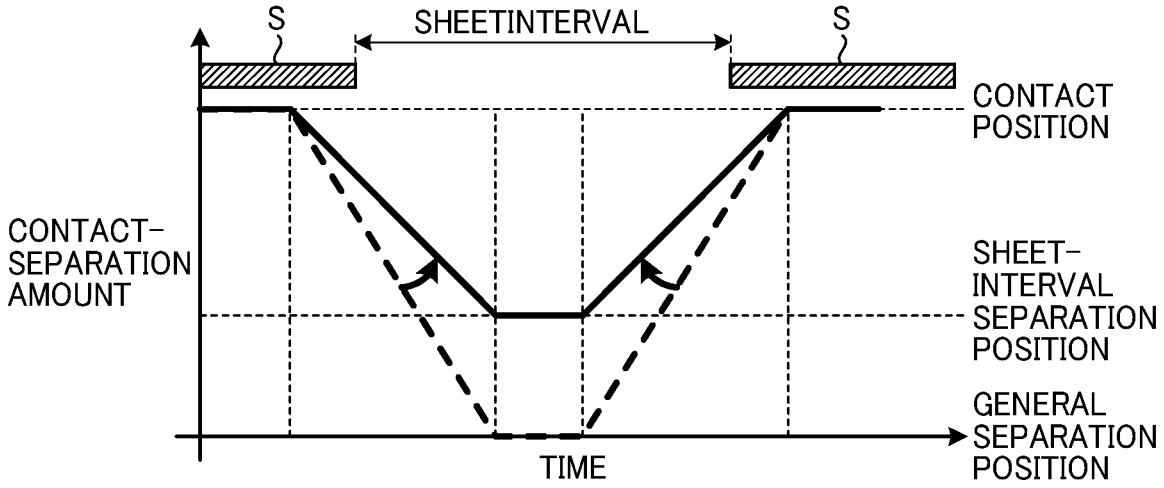
FIG. 8 is a diagram illustrating in detail the contact and separation operations of the secondary-transfer contact-separation device of FIG. 2.

FIG. 8 is a diagram illustrating in detail the contact and separation operations of the secondary-transfer contact-separation device 60.

As illustrated in FIG. 8, the sheet-interval separation position is a position closer to the contact position at which the secondary transfer roller 17 contacts the intermediate transfer belt 15 than the general separation position (i.e., the first position) during general standby. In other words, the distance between the intermediate transfer belt 15 and the secondary transfer roller 17 at the sheet-interval separation position is shorter than the distance between the intermediate transfer belt 15 and the secondary transfer roller 17 at the general separation position.

In a typical secondary-transfer contact-separation control, an intermediate transfer belt and a secondary transfer device are to be completely separated from each other when printing is not performed. The intermediate transfer belt and the secondary transfer device are to be separated from each other in the same manner between printing or recording sheets. Therefore, a motor is operated at a relatively high speed between the recording sheets to transfer an image on a succeeding one of the recording sheets in good time. However, in the typical secondary-transfer contact-separation control, since the motor refrains from being rotated at a relatively high speed at once due to the hardware restriction that the motor steps out, extra time is needed for the through-up and through-down control of the motor, and therefore the adjustment of the operation timing becomes complicated.

By contrast, according to the present embodiment, the secondary transfer roller 17 is located at the sheet-interval separation position in an interval between the recording sheets S, thus being separated from the intermediate transfer belt 15. Accordingly, a total moving amount is reduced during the contact and separation operations in the secondary-transfer contact-separation control. Accordingly, the contact and separation speed (i.e., the speed of the eccentric cams 61 rotated by the stepping motor 63) is reduced compared to typical contact and separation operations during the same moving time, thus alleviating the impacts of physical contact and separation of the rollers and reducing the shock jitter.

Here, the interval between the recording sheets S is a period from when a preceding sheet S of the recording sheets S continuously conveyed comes out of the secondary transfer nip to when a succeeding sheet following the preceding sheet S enters the secondary transfer nip. In addition, the standby is a time other than the interval between the recording sheets S. The standby includes a time after the power of the printer P is turned on and a job, that is, a print command is received in FIG. 6.

Referring back to FIG. 7, a description is now given of the canceller contact operation.

After stopping the secondary transfer roller 17 at the sheet-interval separation position (i.e., the second position), in (7) in FIG. 7, the controller 200 of the printer P causes the stepping motor 63 to rotate in the CW direction at a canceller contact (y) time.

Next in (8) in FIG. 7, when detecting the change from the absence of the filler to the presence of the filler, that is, when detecting the separation of the secondary transfer roller 17 from the intermediate transfer belt 15 (and the secondary transfer opposed roller 16), the controller 200 of the printer P causes the stepping motor 63 to rotate by a given pulse for each of the recording sheets S to bring the secondary transfer roller 17 into contact with the intermediate transfer belt 15 (and the secondary transfer opposed roller 16) and stops the secondary transfer roller 17.

Now, a description is given of the canceller separation operation.

In (9) in FIG. 7, the controller 200 of the printer P causes the stepping motor 63 to rotate in the CCW direction at a canceller separation (β) time. Note that in a case in which there is no sheet information of the next recording sheet S at the canceller separation (β) time, the controller 200 of the printer P determines that the present recording sheet S is the last sheet of the recording sheets S continuously conveyed and assigns the next recording sheet S as the first sheet.

Next in (10) in FIG. 7, when detecting the change from the presence of the filler to the absence of the filler, that is, when detecting the separation of the secondary transfer roller 17 from the intermediate transfer belt 15 (and the secondary transfer opposed roller 16), the controller 200 of the printer P causes the stepping motor 63 to rotate by a given pulse for each of the recording sheets S and stops the secondary transfer roller 17 at the sheet-interval separation position.

Now, a description is given of the canceller contact operation.

In (7) after the canceller separation operation, the controller 200 of the printer P causes the stepping motor 63 to rotate in the CW direction at the canceller contact (y) time.

Next in (8) in FIG. 7, when detecting the change from the absence of the filler to the presence of the filler, that is, when detecting the separation of the secondary transfer roller 17 from the intermediate transfer belt 15 (and the secondary transfer opposed roller 16), the controller 200 of the printer P causes the stepping motor 63 to rotate by a given pulse for each of the recording sheets S to bring the secondary transfer roller 17 into contact with the intermediate transfer belt 15 (and the secondary transfer opposed roller 16) and stops the secondary transfer roller 17.

Here, as illustrated in FIG. 7, the contact position is changed because the given number of pulses is changed depending on at least one of the thickness of the recording sheet S and the type of the recording sheet S. In other words, the controller 200 of the printer P is configured to change the sheet-interval separation position depending on at least one of the thickness of the recording sheet S and the type of the recording sheet S.

The controller 200 of the printer P controls the sheet-interval separation position of the secondary transfer roller 17 such that the secondary transfer roller 17 is more separated from the contact position at which the secondary transfer roller 17 contacts the intermediate transfer belt 15 as the thickness of the recording sheet S increases. In addition, the controller 200 of the printer P controls the sheet-interval separation position of the secondary transfer roller 17 such that the secondary transfer roller 17 is more separated from the contact position at which the secondary transfer roller 17 contacts the intermediate transfer belt 15 as the stiffness of the recording sheet S increases. As the thickness or stiffness of the recording sheet S increases, the impact generated when the recording sheet S enters the secondary transfer nip increases and the image quality may decrease. In the present embodiment, the distance between the secondary transfer roller 17 and the intermediate transfer belt 15 increases as the thickness or stiffness of the recording sheet S increases. Accordingly, the impact generated when the recording sheet S enters the secondary transfer nip is reduced and the image quality remains without decreasing.

Thereafter, in (9) in FIG. 7, the controller 200 of the printer P causes the stepping motor 63 to rotate in the CCW direction at the canceller separation (β) time. Note that in a case in which there is no sheet information of the next recording sheet S at the canceller separation (β) time, the controller 200 of the printer P determines that the present recording sheet S is the last sheet of the recording sheets S continuously conveyed and assigns the next recording sheet S as the first sheet.

In the example illustrated in FIG. 7, there is no sheet information of the next recording sheet S at the canceller separation (β) time.

Next in (10) in FIG. 7, when determining that the present recording sheet S is the last sheet of the recording sheets S continuously conveyed and detecting the change from the presence of the filler to the absence of the filler, that is, when determining that the present recording sheet S is the last sheet of the recording sheets S continuously conveyed and detecting the separation of the secondary transfer roller 17 from the intermediate transfer belt 15 (and the secondary transfer opposed roller 16), the controller 200 of the printer P causes the stepping motor 63 to rotate by a given pulse for each of the recording sheets S to stop the secondary transfer roller 17 at the general separation position.

Now, a description is given of the first-sheet limited operation (in the separation state).

Thereafter, in a case in which the present recording sheet S is determined as the last sheet of the recording sheets S continuously conveyed and the next recording sheet S is assigned as the first sheet, in (11) in FIG. 7, the controller 200 of the printer P causes the stepping motor 63 to rotate, at a (WAIT) dummy Fgate time, in the CW direction by a given pulse for each of the recording sheets S, thus stopping the secondary transfer roller 17 away from the intermediate transfer belt 15 (and the secondary transfer opposed roller 16).

As described above, according to the present embodiment, the total moving amount is reduced during the contact and separation operations in the secondary-transfer contact-separation control as the sheet-interval separation position is newly provided in the interval between the recording sheets S. As described above, the sheet-interval separation position is a position closer to the contact position at which the secondary transfer roller 17 contacts the intermediate transfer belt 15 than the general separation position during general standby. In other words, the distance between the intermediate transfer belt 15 and the secondary transfer roller 17 at the sheet-interval separation position is shorter than the distance between the intermediate transfer belt 15 and the secondary transfer roller 17 at the general separation position.

In addition, according to the present embodiment, the controller 200 decreases the rotational speed of the stepping motor 63 of the secondary-transfer contact-separation device 60 in the interval between the recording sheets S. Accordingly, the contact and separation operations are performed at lower speed compared to a typical contact and separation operations, though the operation time is the same, thus alleviating the impact of physical contact and separation of the rollers and reducing the shock jitter.

Further, since the total moving amount is reduced during the contact and separation operations in the secondary-transfer contact-separation control, the stepping motor 63 refrains from rotating at a relatively high speed. In other words, the through-up and through-down control of the stepping motor 63 is not needed. Accordingly, the present embodiment simplifies the adjustment of timing of the contact and separation operations.

Figure 9:
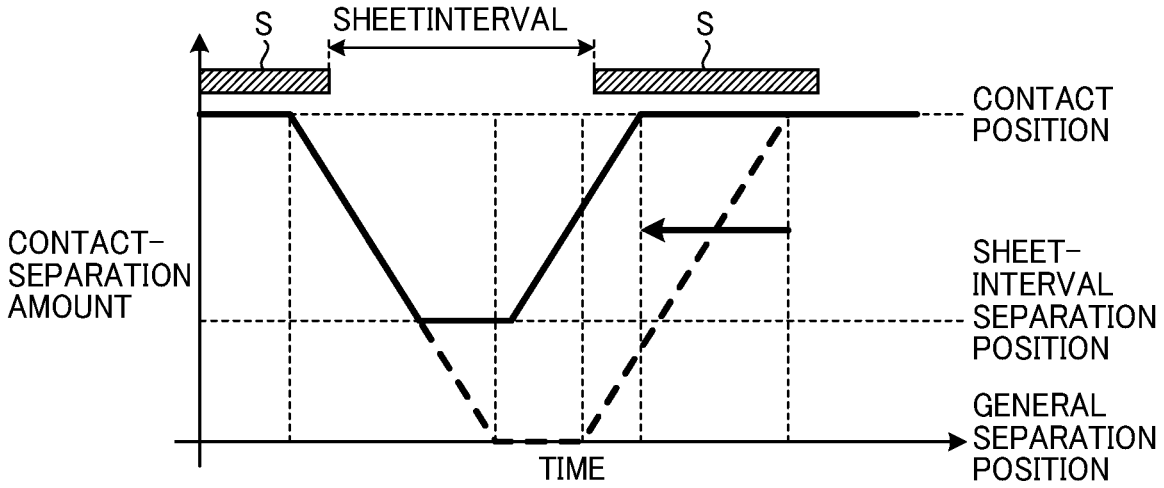
FIG. 9 is diagram illustrating in detail contact and separation operations of a secondary-transfer contact-separation device according to a second embodiment.

Referring now to FIG. 9, a description is given of a second embodiment of the present disclosure.

The second embodiment is different from the first embodiment in that the duration of the contact and separation operations is shortened. A redundant description of identical features in the first and second embodiments is herein omitted; whereas a description is now given of features of the second embodiment different from the features of the first embodiment.

FIG. 9 is diagram illustrating in detail contact and separation operations of the secondary-transfer contact-separation device 60 according to the second embodiment.

As illustrated in FIG. 9, the sheet-interval separation position is a position closer to the contact position at which the secondary transfer roller 17 contacts the intermediate transfer belt 15 than the general separation position during general standby. In other words, the distance between the intermediate transfer belt 15 and the secondary transfer roller 17 at the sheet-interval separation position is shorter than the distance between the intermediate transfer belt 15 and the secondary transfer roller 17 at the general separation position. As described above, the secondary transfer roller 17 is located at the sheet-interval separation position in an interval between the recording sheets S, thus being separated from the intermediate transfer belt 15. Accordingly, a total moving amount is reduced during the contact and separation operations in the secondary-transfer contact-separation control.

In the present embodiment, as illustrated in FIG. 9, the distance between the recording sheets S is shortened while the contact-separation speed (i.e., rotational speed of the eccentric cams 61) is the same as the contact-separation speed with respect to a typical general separation position. In other words, the controller 200 maintains the rotational speed of the stepping motor 63 of the secondary-transfer contact-separation device 60 in the interval between the recording sheets S.

As described above, the sheet-interval separation position is a position closer to the contact position at which the secondary transfer roller 17 contacts the intermediate transfer belt 15 than the general separation position during general standby. In other words, the distance between the intermediate transfer belt 15 and the secondary transfer roller 17 at the sheet-interval separation position is shorter than the distance between the intermediate transfer belt 15 and the secondary transfer roller 17 at the general separation position. Since the duration of the contact and separation operations is shortened at the same contact and separation speed as typical contact and separation speed, the contact and separation operations are performed at shorter sheet-interval time (i.e., higher conveyance speed). Thus, the present embodiment enhances the productivity.

Thus, according to the present embodiment, the total moving amount is reduced during the contact and separation operations in the secondary-transfer contact-separation control as the sheet-interval separation position is newly provided in the interval between the recording sheets S. As described above, the sheet-interval separation position is a position closer to the contact position at which the secondary transfer roller 17 contacts the intermediate transfer belt 15 than the general separation position during general standby. In other words, the distance between the intermediate transfer belt 15 and the secondary transfer roller 17 at the sheet-interval separation position is shorter than the distance between the intermediate transfer belt 15 and the secondary transfer roller 17 at the general separation position. Since the duration of contact and separation operations is shortened at the same contact and separation speed as typical contact and separation speed, the contact and separation operations are performed at shorter sheet-interval time (i.e., higher conveyance speed). Thus, the present embodiment enhances the productivity.

Note that in the embodiments described above, the electrophotographic printer P is described as an image forming apparatus. Instead of the printer, the image forming apparatus of an embodiment of the present disclosure may be, e.g., a copier, a scanner, a facsimile machine, or a multifunction peripheral (MFP) having at least two of copying, printing, scanning, and facsimile functions.

In a case in which the image forming apparatus is a printer, the image forming apparatus may be a color printer or a monochrome printer. According to an embodiment of the present disclosure, a secondary transfer belt may be used instead of the secondary transfer roller 17. According to an embodiment of the present disclosure, an intermediate transfer drum may be used instead of the intermediate transfer belt 15.

According to the embodiments of the present disclosure, a total moving amount is reduced during contact and separation operations in the secondary-transfer contact-separation control.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

What is claimed is:

1. An image forming apparatus comprising:

a transferred body to which a toner image is transferred;

a transfer device configured to transfer the toner image from the transferred body onto a recording medium;

a contact-separation device including a motor, the contact-separation device being configured to drive the motor to move the transfer device away from or into contact with the transferred body; and circuitry configured to cause the contact-separation device to move the transfer device away from or into contact with the transferred body, the circuitry being configured to:

move the transfer device away from the transferred body to a first position during standby; and locate the transfer device at a second position that is closer to a contact position at which the transfer device is configured to contact the transferred body than the first position in an interval between the recording medium and a succeeding recording medium, wherein the second position is a controlled maximum distance of the transfer device away from the transferred body during the interval between the recording medium and the succeeding recording medium, and the controlled maximum distance is closer to the contact position than the first position.

2. The image forming apparatus according to claim 1, wherein the circuitry is configured to decrease a rotational speed of the motor of the contact-separation device in the interval between the recording medium and the succeeding recording medium.

3. The image forming apparatus according to claim 1, wherein the circuitry is configured to maintain a rotational speed of the motor of the contact-separation device in the interval between the recording medium and the succeeding recording medium.

4. The image forming apparatus according to claim 1, wherein the circuitry is configured to change the second position depending on at least one of a thickness of the recording medium and a type of the recording medium.

5. The image forming apparatus according to claim 1, wherein the circuitry is configured to move the transfer device away from the transferred body to the first position after the transfer device transfers the toner image onto a last recording medium of recording media continuously conveyed.

6. The image forming apparatus according to claim 1, further comprising a plurality of latent image bearers, wherein the transferred body is an intermediate transfer member on which respective toner images formed on the plurality of latent image bearers are superimposed one atop another, and wherein the transfer device is a secondary transfer device configured to secondarily transfer the toner images from the intermediate transfer member onto the recording medium.

7. The image forming apparatus according to claim 1, wherein a time interval of the transfer device being at the first position is a same amount of time as a time interval of the transfer device being at the second position.

8. The image forming apparatus according to claim 1, wherein an elapsed time from the contact position to the first position is a same amount of time as an elapsed time from the contact position to the second position.

9. The image forming apparatus according to claim 1, wherein an elapsed time from the contact position to the first position is longer than an elapsed time from the contact position to the second position.

10. The image forming apparatus according to claim 1, wherein an elapsed time from the contact position to the contact position via the first position is longer than an elapsed time from the contact position to the contact position via the second position.

* * * * *